United States Patent [19]

Brzezinski et al.

[11] Patent Number: 4,655,726

[45] Date of Patent: Apr. 7, 1987

[54] TOY DOLL FIGURE FOR DISPLAYING COLORS

[75] Inventors: Ryszard J. Brzezinski, Long Beach; William J. Kelley, Torrance, both of Calif.

[73] Assignee: Mattel, Inc., Hawthorne, Calif.

[21] Appl. No.: 782,808

[22] Filed: Oct. 2, 1985

[51] Int. Cl.[4] ..... A63H 3/00

[52] U.S. Cl. ..... 446/268; 446/486

[58] Field of Search ..... 446/149, 150, 151, 152, 446/268, 321, 345, 352, 353, 376, 486; 273/142 JC, 143 C, 143 D; 40/459, 460, 497, 498, 506, 507, 524, 528

[56] References Cited

U.S. PATENT DOCUMENTS

| | | | |
|---|---|---|---|
| 716,858 | 12/1902 | Brentano | 446/150 |
| 1,060,998 | 5/1913 | Moss | 446/150 X |
| 2,591,379 | 4/1952 | Schradermeier | 446/268 X |
| 2,731,267 | 1/1956 | Brenner | 273/143 R |
| 2,749,657 | 6/1956 | Lohnes | 446/150 |
| 3,228,695 | 1/1966 | Ryan | 273/143 C |
| 3,734,509 | 5/1973 | Glass | 273/139 |
| 3,830,012 | 8/1974 | Franke | 446/321 |
| 3,944,691 | 3/1976 | Smith | 446/268 X |
| 3,945,644 | 1/1975 | Ortiz | 273/143 D |
| 4,225,138 | 9/1980 | Wolf | 273/243 |

*Primary Examiner*—Richard T. Stouffer

*Attorney, Agent, or Firm*—Ronald M. Goldman; Melvin A. Klein; Daniel F. Sullivan

[57] ABSTRACT

A toy doll figure for displaying colors through an opening formed in the torso of the doll figure. The torso opening is covered with a hinged flap member. Disposed inside the torso which is a hollow housing is a drum member that is journaled in the housing. The drum member is covered with colored strip members that extend parallel to the longitudinal axis of the drum member. The drum member has a ratchet member with ratchet teeth mounted thereon that is driven by opening and closing the hinged flap member on the torso exposing a different colored strip member.

6 Claims, 8 Drawing Figures

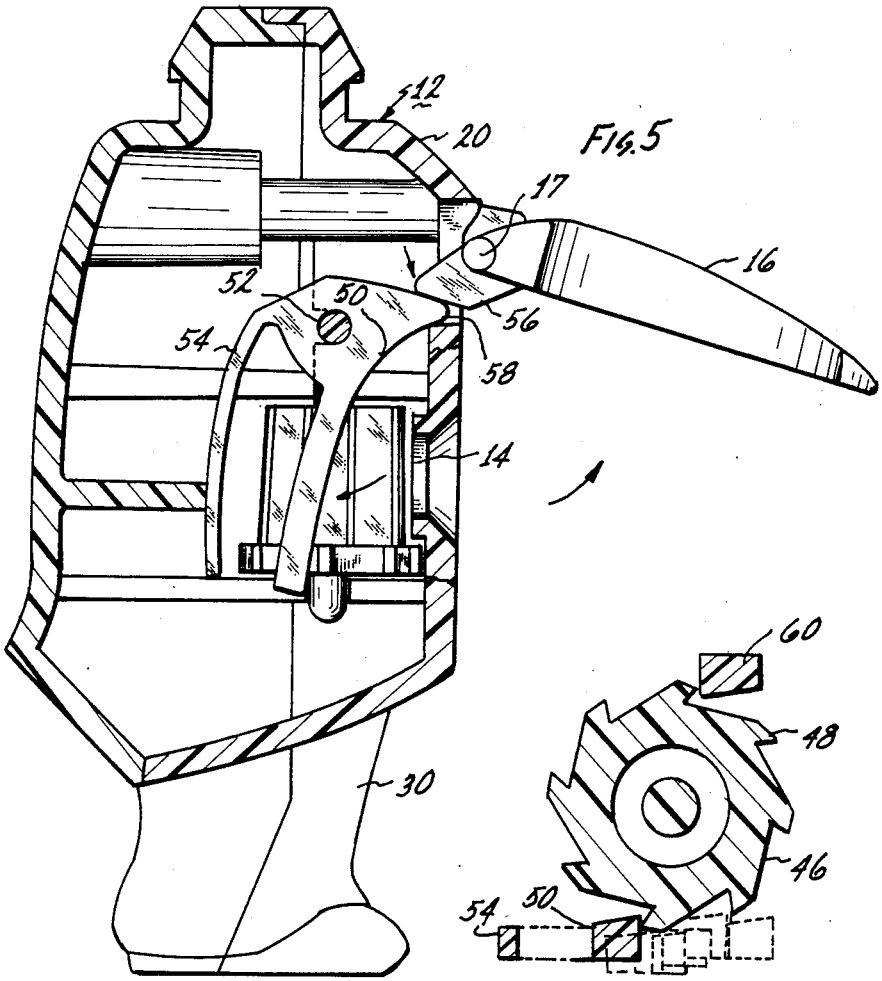
FIG. 5
FIG. 6
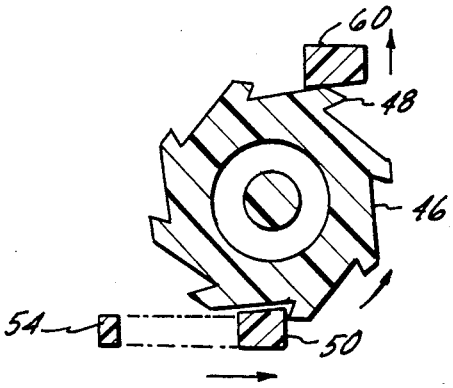
FIG. 7

TOY DOLL FIGURE FOR DISPLAYING COLORS

BACKGROUND OF THE INVENTION

1. Field Of The Invention

This invention relates to a toy doll figure and in particular to a new and improved toy doll figure mechanism for displaying colors from a drum disposed on the interior of the toy doll figure.

2. Description Of The Prior Art

U.S. Pat. No. 2,731,267 to Brenner issued Jan. 17, 1956 shows a rotating chance game apparatus for playing well known games such as dice, roullette, poker and baseball as well as other games. The apparatus includes disk wheels having marked segments and journaled to rotate to expose a single marked segment on each disk wheel through a side opening or window in a casing.

U.S. Pat. No. 3,228,695 to Ryan issued Jan. 11, 1966 shows a musical mechanism and game apparatus including a mechanism adapted to operate as a roullette wheel which has a plurality of signs of varied colors spaced around a circumference. Coins are used for playing the mechanism.

U.S. Pat. No. 3,734,509 to Glass et al issued May 22, 1973 is for an invisible indicia matching and display device which includes a housing and a display assembly mounted within the housing and illuminating means located within the housing. The housing has a window for observation therein and a slot for receiving a playing card therein. The display assembly has a second set of characters associated therewith so that they are visible one at a time through the window.

U.S. Pat. No. 3,945,644 to Ortiz issued Jan. 6, 1975 is for a rotatable disk chance device exposing symbols through windows formed in a base wall. A variable position of the top may be partially controlled by a manually operated brake operable by each player during his playing turn.

U.S. Pat. No. 4,225,138 to Wolf issued Sept. 30, 1980, is for a tortoise and hare game which includes a drive wheel driving a ball tumbler which causes different colored balls to be seen in a window during the playing of the game.

SUMMARY OF THE INVENTION

A toy doll figure is provided for displaying different colors through an opening in the torso on the doll figure. Disposed inside the torso of the doll figure is a drum member having multiple colored strips positioned in parallel to the longitudinal axis of the drum member around the circumference of the drum surface. A strip member is visible through the opening formed in the torso for viewing from the outside of the torso. A flap member is pivotally mounted on the torso by a hinge in overlying position to the opening formed therein. A driven mechanism is mounted on the drum member in the form of ratchet teeth at one end thereof. The ratchet teeth are driven by opening and then closing the hinged flap member which actuates a lever member engaging the teeth causing the drum member to rotate and expose a different color segment upon each opening and closing of the flap member. The lever member is actuated upon opening of the flap member causing the lever member to ride over the ratchet teeth. Upon closing of the flap member, the lever member is urged towards its original position by spring biasing to advance the ratchet teeth one position. As a result the rotation of the drum member exposes a different color strip member when the flap member is next opened.

BRIEF DESCRIPTION OF THE DRAWINGS

FIG. 5 is a sectional view of the toy doll figure similar to FIG. 3 with the flap member in the opened position;

FIGS. 6 and 7 are sectional views similar to FIG. 4 illustrating the operating positions of the lever member for engaging the ratchet teeth of the drum member.

DESCRIPTION OF THE PREFERRED EMOBODIMENT

Figure 3:
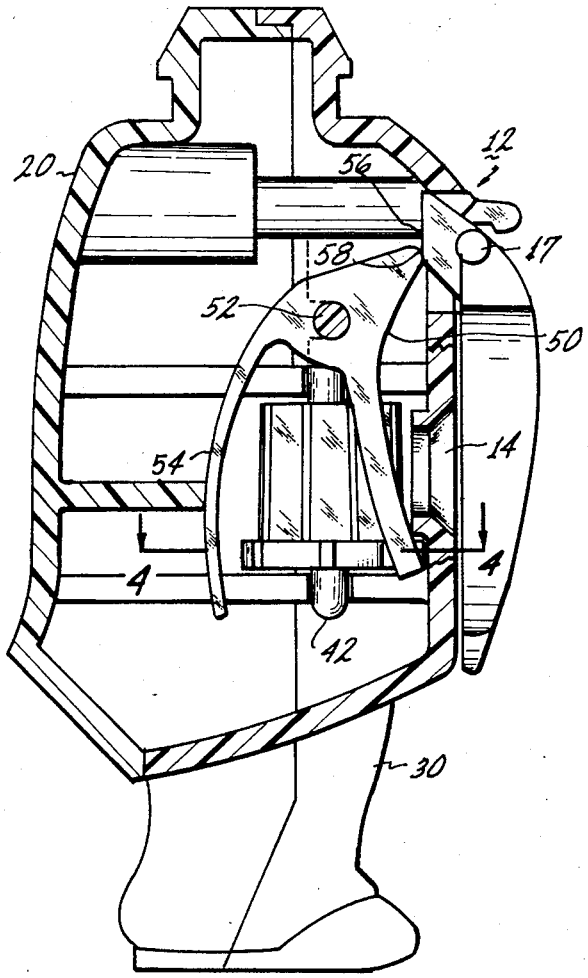
FIG. 3 is a sectional view of the toy doll figure taken along lines 3—3 in FIG. 2.
Figure 4:
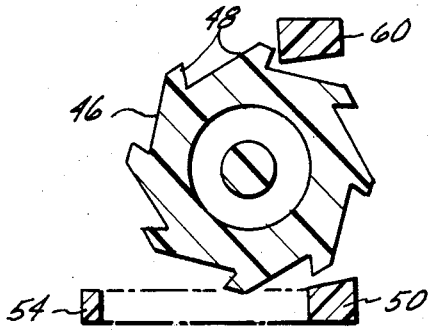
FIG. 4 is a sectional view taken along lines 4—4 of FIG. 3.

Refering now to FIGS. 1–8 there is shown a toy doll figure generally designated 10 according to the present invention. The toy doll FIG. 10 includes a torso 12 having an opening 14 formed therein (FIG. 3). A flap member 16 is positioned in overlying position with the opening 14 and is pivotally mounted on the torso member by a hinge 16 supported by journal portions 18 on the torso member. The torso 12 has a housing 20 that is hollow and that terminates in a post 22 at the upper extent thereof. An oversized head 24 with elephant-like ears 26 and relatively large eyes 28 and a beak 29 is positioned for engagment with the post 22 of the torso. Supportin9 the torso are a pair of short stubby leg portions 30 each of which terminate in a foot 32 with a plurality of toes 34 to depict an animated and amusing creature.

Figure 1:
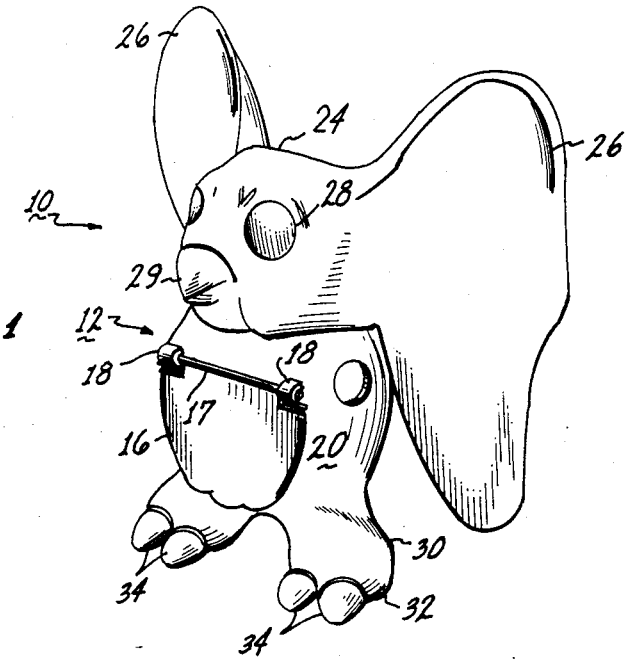
FIG. 1 is a perspective view of the toy doll figure according to the present invention.
Figure 8:
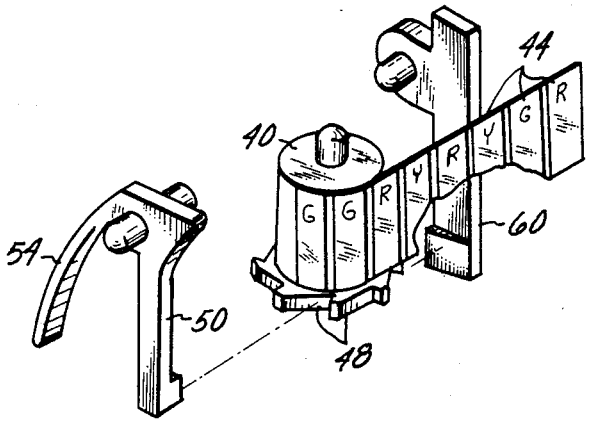
FIG. 8 is a perspective view of the drum member with the colored strip members illustrating certain details of the assembly.
Figure 2:
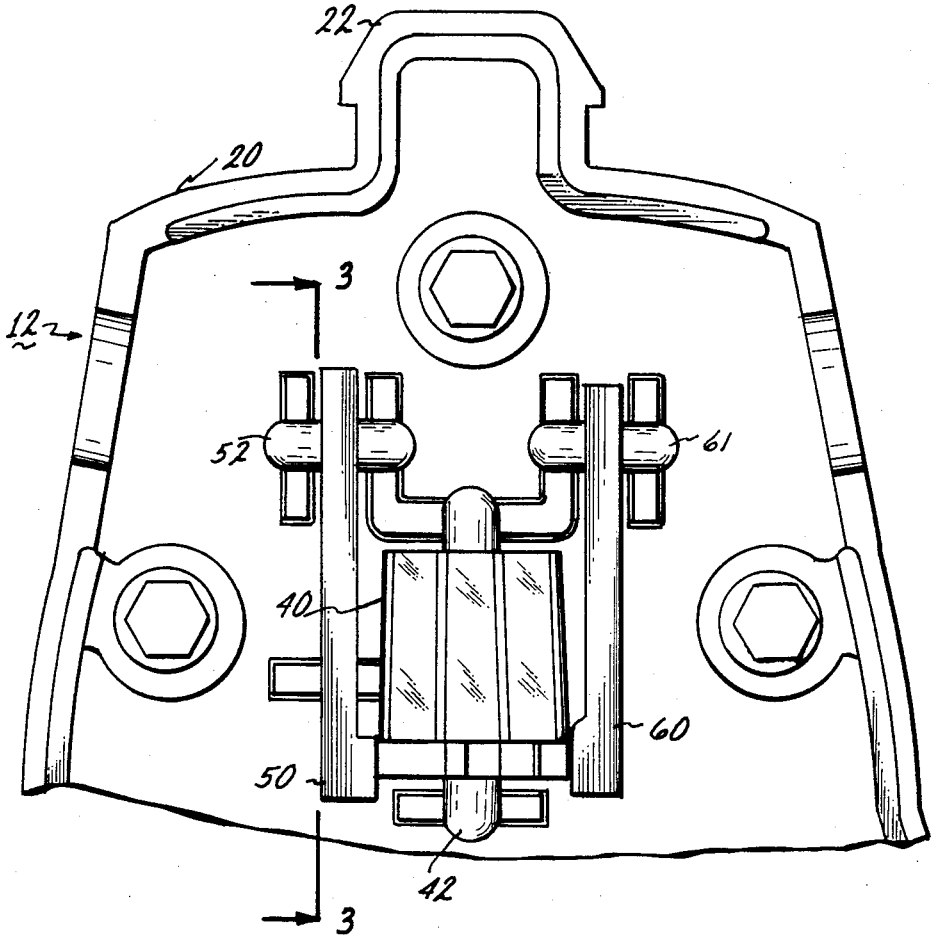
FIG. 2 is a sectional view of the torso of the toy doll figure of the invention.

Disposed inside of the torso 12 is a drum member 40 mounted on a shaft 42 that is journaled in the housing 20 of the torso. Wrapped around the cylindrical surface of the drum are parallel strips 44 that are parallel to the longitudinal axis of the drum member. Strips 44 are different colors such as green, red, yellow (FIG. 8). Upon rotation of the drum member a different colored strip 44 is positioned for viewing through the opening 14 of the torso in a manner which will be described more fully hereinafter.

Positioned at one end of the drum member is a ratchet member 46 having ratchet teeth 48 thereon. Disposed inside of the torso adjacent to the drum member is a lever member 50 that is journaled in the torso housing for pivotable movement on an axis of pin 52. Integrally formed with the lever member is a leaf spring 54 that extends in the same direction and to the same longitudinal extent as the lever member. The flap member 16 is formed with a protuberance 56 that engages a protuberance 58 extending from the lever member (FIG. 5). Upon opening of the flap member 16 the lever member 50 which is made of resilient material ratchets over the ratchet teeth 48 in a direction away from opening 14 (FIG. 6). Upon closing of the flap member 16 the protuberance 56 is released from engagment with the protuberance 58 resulting in the lever member 50 being urged forwardly against the closest ratchet tooth 48 due to the biasing action of the leaf spring 54 thereby resulting in the ratchet member and drum member by rotation thereof being advanced. Upon advancement of the ratchet member and the drum member to a new position, a different colored segment strip is exposed through the opening 14. As a result upon lifting of the flap member 16 again a different colored strip 44 is observed through the opening 14.

Positioned on the opposite side of the drum member from the lever member is a pawl member 60 pivotable on the axis of a pin 61 which serves to engage the ratchet teeth 48 to prevent the ratchet teeth 48 from rotating in a direction opposite to the direction of rotation caused by actuation and engagment of the lever member with the ratchet teeth.

It will now be appreciated that a new and amusing toy figure doll is provided for entertaining and amusing young children with different color strips upon lifting and closing of a flap member on the torso of the doll figure. Thus the device is quite useful and entertaining and yet is simple and reliable in operation.

Though the invention has been described with respect to a specific preferred embodiment thereof, many variations and modifications thereof will immediately become apparent to those skilled in the art. It is therefore the intention that the appended claims be interrupted as broadly as possible in view of the prior to include all such variations and modifications.

I claim:

1. A toy doll figure for displaying colors comprising:

a torso having an opening formed therein;

a cylindrically shaped drum member disposed on a vertical axis inside of the torso, said drum member having multiple colored strips positioned in parallel to the longitudinal axis of the drum member such that one of the colored strips is positioned within the opening for viewing from outside the torso;

a flap member pivotally hinged to the torso covering the opening and moveable to open and closed positions;

a rotatable mechanism mounted on the drum member to cause rotation thereof; and drive means connected to said flap member and engaging said rotatable mechanism, said drive means including a lever member pivotable on a horizontal axis, said lever member having a leaf spring integrally formed therewith, said lever member being urged into engagement with said rotatable mechanism by said leaf spring when said flap member is closed, whereby when said flap member is pivoted to open and closed positions said drum member is rotated a predetermined extent to expose a different colored strip on said drum member.

2. A toy doll figure according to claim 1 wherein said drum member is mounted on a shaft journaled in said torso and said rotatable mechanism includes ratchet teeth connected at one end of said drum member.

3. A toy doll figure according to claim 2 including a pawl member on the opposite side of the drum member from the lever member to prevent rotation of the drum member in a direction opposite to the direction of rotation.

4. A toy doll figure according to claim 3 wherein said lever member and pawl member are made of resilient material.

5. A toy doll figure according to claim 1 including an enlarged head with elephant like ears and relatively large eyes mounted on the torso.

6. A toy doll figure according to claim 5 including a pair of short legs each having a foot extending therefrom for supporting the torso.

* * * * *